US010556141B2

(12) United States Patent
Laitta et al.

(10) Patent No.: US 10,556,141 B2
(45) Date of Patent: Feb. 11, 2020

(54) DIVING BOARD WITH COMPOSITE TREAD

(71) Applicant: S.R. Smith, LLC, Canby, OR (US)

(72) Inventors: Richard P. Laitta, Lake Oswego, OR (US); Mikha-el Kaiel, Portland, OR (US)

(73) Assignee: S.R. SMITH, LLC, Canby, OR (US)

( * ) Notice: Subject to any disclaimer, the term of this patent is extended or adjusted under 35 U.S.C. 154(b) by 141 days.

(21) Appl. No.: 15/725,184

(22) Filed: Oct. 4, 2017

(65) Prior Publication Data

US 2018/0093118 A1 Apr. 5, 2018

Related U.S. Application Data

(60) Provisional application No. 62/403,871, filed on Oct. 4, 2016.

(51) Int. Cl.
*A63B 5/10* (2006.01)
*A63B 71/00* (2006.01)

(52) U.S. Cl.
CPC ..... *A63B 5/10* (2013.01); *A63B 71/0054* (2013.01); *A63B 2208/03* (2013.01); *A63B 2209/00* (2013.01); *A63B 2244/203* (2013.01)

(58) Field of Classification Search
CPC .... A63B 5/00; A63B 5/08; A63B 5/10; A63B 2005/085; A63B 71/0054; A63B 2071/0063; A63B 2208/03; A63B 2209/00; A63B 2209/02; A63B 2209/023; A63B 2209/026; A63B 2209/10; A63B 2209/14; A63B 2244/203; A63B 2244/206
See application file for complete search history.

(56) References Cited

U.S. PATENT DOCUMENTS 2,594,459 A 4/1952 Larson, Jr.
2,963,294 A * 12/1960 Buck ..... A63B 5/10 482/30
2,965,529 A * 12/1960 Bright ..... A63B 5/10 428/45
3,371,928 A * 3/1968 Buddo ..... A63B 5/10 482/30
3,408,069 A * 10/1968 Lewis ..... A63B 5/10 482/30

(Continued)

FOREIGN PATENT DOCUMENTS

JP 2001-037907 A 2/2001

OTHER PUBLICATIONS

International Search Report and Written Opinion for International Application No. PCT/US2017/021665, received Jun. 9, 2017, 12 pages.

(Continued)

*Primary Examiner* — Gary D Urbiel Goldner
(74) *Attorney, Agent, or Firm* — Stoel Rives LLP

(57) ABSTRACT

A diving board having a shell including a top surface with one or more pockets formed thereon. The pockets are recessed inwardly from the top surface of the shell and sized to receive a non-slip tread surface therein. The tread surface may be made from any of a variety of suitable materials, such as a composite material primarily comprising cork, and arranged such that the tread surface is substantially flush relative to the top surface of the shell when seated therein. An adhesive layer may be used to adhere the tread surface in the pocket of the shell.

20 Claims, 4 Drawing Sheets

(56) References Cited

U.S. PATENT DOCUMENTS

| | | | | | |
|---|---|---|---|---|---|
| 3,415,516 | A * | 12/1968 | Mattingly | A63B 5/10 | 482/30 |
| 3,416,793 | A * | 12/1968 | Fox | A63B 5/10 | 482/30 |
| 3,544,104 | A * | 12/1970 | Jenks | A63B 5/10 | 482/30 |
| 3,861,674 | A * | 1/1975 | Buck, Jr. | A63B 5/10 | 482/30 |
| 3,862,755 | A * | 1/1975 | Ogden | A63B 5/10 | 482/30 |
| 4,303,238 | A * | 12/1981 | Rude | A63B 5/10 | 482/30 |
| 2003/0134715 | A1* | 7/2003 | Kiefer | A63B 5/10 | 482/19 |
| 2011/0059826 | A1 | 3/2011 | Isaacson et al. | | |
| 2014/0057757 | A1 | 2/2014 | Isaacson et al. | | |
| 2016/0024803 | A1* | 1/2016 | Chitouras | E04F 15/02016 | 428/189 |
| 2016/0220030 | A1 | 8/2016 | Chenfu et al. | | |

OTHER PUBLICATIONS

Comcork Flooring "Aquadeck—Round or Diamond Profile", available as of Oct. 4, 2016, http://comcork.com.au/comcork/products/aquadeck_-_round_or_diamond_profile/, retrieved on Oct. 4, 2017, 3 pages.

* cited by examiner

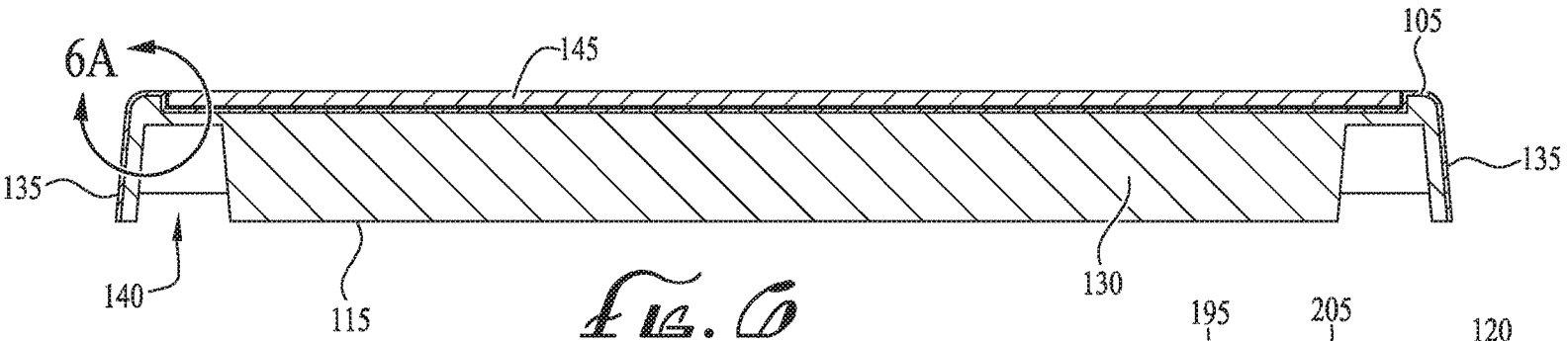
FIG. 6
FIG. 6A
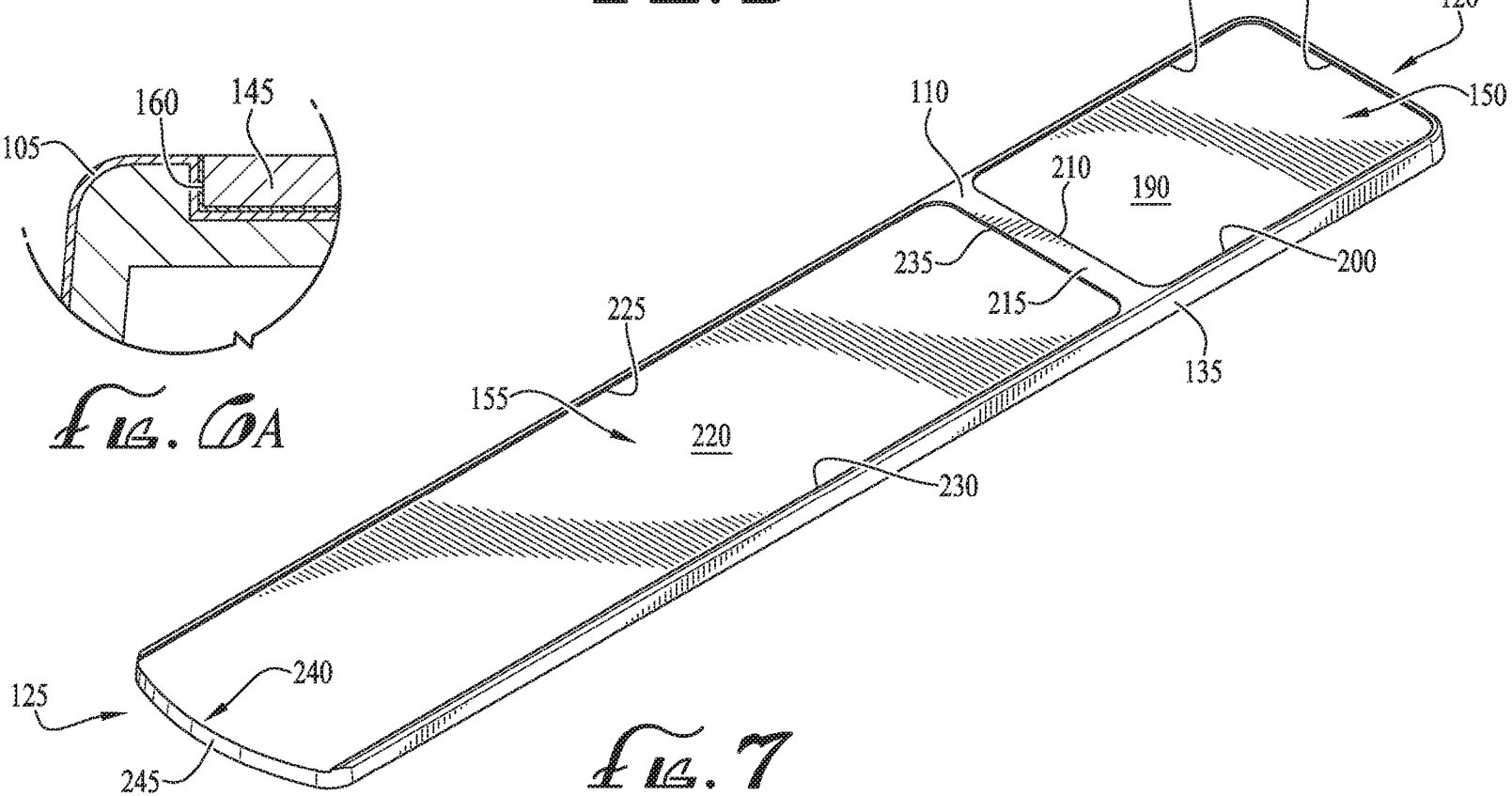
FIG. 7

DIVING BOARD WITH COMPOSITE TREAD

RELATED APPLICATION DATA

This application is a nonprovisional of and claims priority under 35 U.S.C. § 119(e) to U.S. Provisional Application No. 62/403,871, filed on Oct. 4, 2016, the disclosure of which is incorporated herein by reference in its entirety.

TECHNICAL FIELD

The field of the present disclosure relates generally to diving boards, and in particular, to diving boards that include a non-slip tread surface made of a cork composite material.

BACKGROUND

Diving boards have long been used to provide lift for a diver jumping into a swimming pool. Conventional diving boards typically comprise a shell, such as an acrylic shell, that is wrapped around a core made of any one of a variety of suitable materials. For example, diving boards used in diving competitions may include aluminum or aluminum alloy cores, while other diving boards, such as those used for residential purposes, may include fiberglass reinforced cores or other suitable cores. In many diving boards, the upper surface typically includes a non-slip tread that provides grip and suitable traction for a diver walking across the board before diving off the end. In conventional diving boards, the non-slip tread is typically a sand tread including a sandpaper material that is adhered or otherwise affixed to portions of the upper surface of the diving board shell.

The present inventors have determined that it would be desirable to have a diving board with a tread surface having improved non-slip characteristics and sufficient flexibility to withstand extended use. Additional aspects and advantages of such a diving board will be apparent from the following detailed description of example embodiments, which proceed with reference to the accompanying drawings.

Understanding that the drawings depict only certain embodiments and are not, therefore, to be considered limiting in nature, these embodiments will be described and explained with additional specificity and detail with reference to the drawings.

BRIEF DESCRIPTION OF THE DRAWINGS

FIG. 6 is a cross-section view of section 6-6 taken from FIG. 5, the cross-section view illustrating the non-slip tread surface positioned in a recessed region of the diving board.

FIG. 6A is an enlarged view of a portion of the cross-section view of FIG. 6.

FIG. 7 is a top isometric view of the diving board of FIG. 1, with the tread surfaces of the diving board removed.

DETAILED DESCRIPTION OF EXAMPLE EMBODIMENTS

Figure 1:
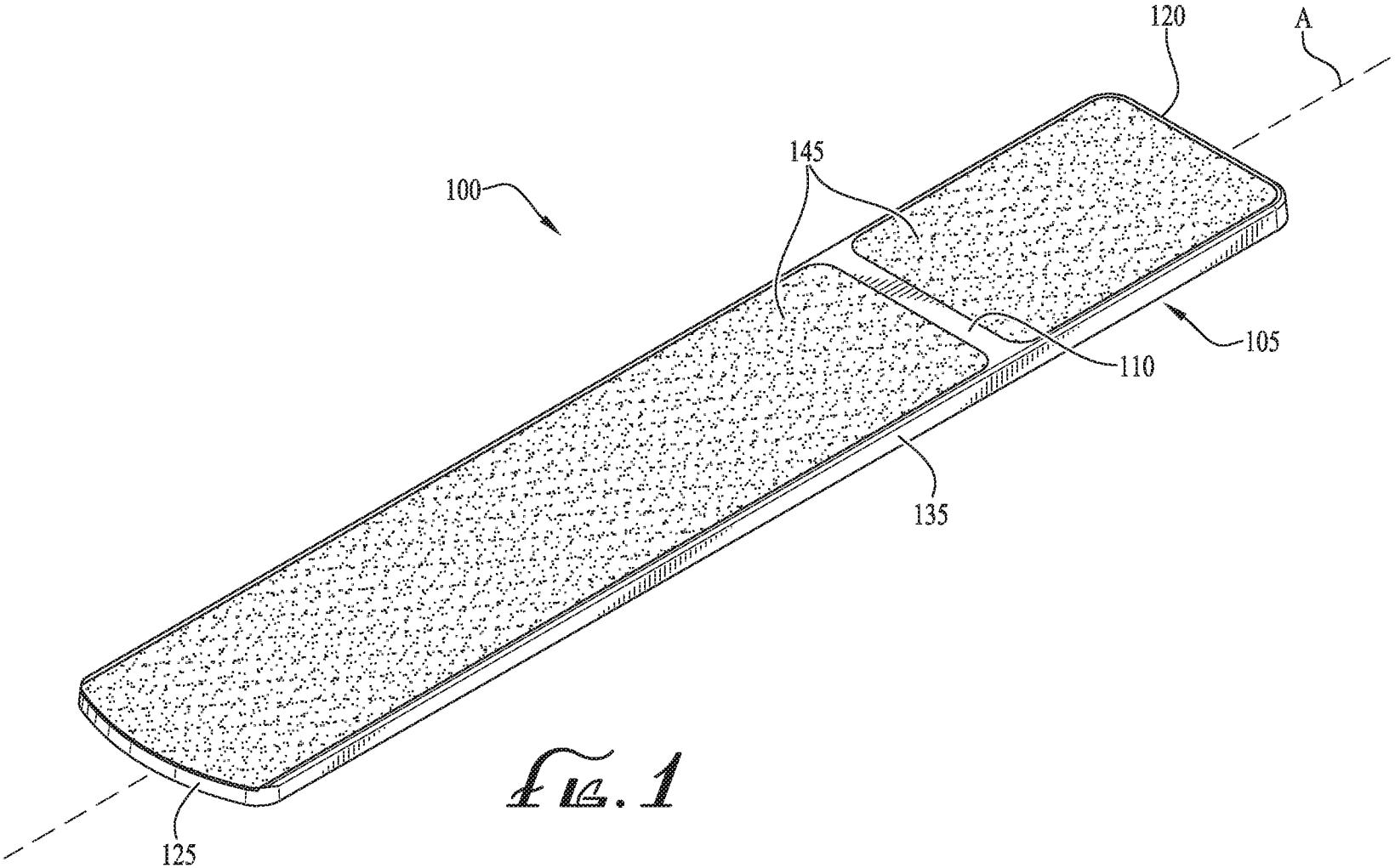
FIG. 1 is a top isometric view of a diving board including a pair of non-slip tread surfaces in accordance with one example embodiment
Figures 2, 3, 4, 5:
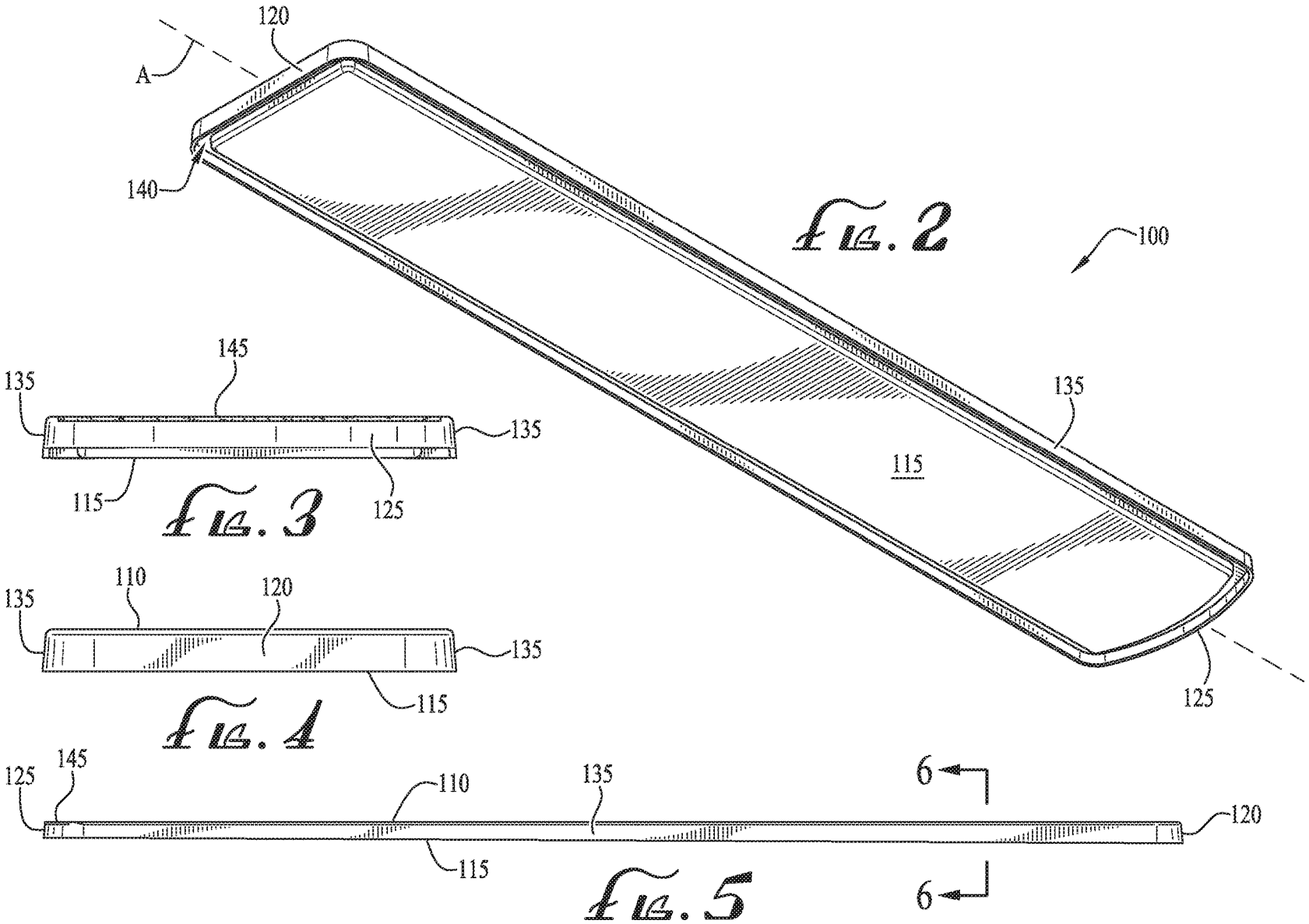
FIG. 2 is a bottom isometric view of the diving board of FIG. 1.
FIG. 3 is a front elevation view of the diving board of FIG. 1.
FIG. 4 is a rear elevation view of the diving board of FIG. 1.
FIG. 5 is a side elevation view of the diving board of FIG. 1.

With reference to the drawings, this section describes particular embodiments of a diving board and its detailed construction and operation. Throughout the specification, reference to "one embodiment," "an embodiment," or "some embodiments" means that a particular described feature, structure, or characteristic may be included in at least one embodiment of the diving board being discussed. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like.

In the following description, particular components of the diving board are described in detail. It should be understood that in some instances, well-known structures, materials, or operations are not shown or not described in detail to avoid obscuring pertinent aspects of the embodiments.

FIGS. 1-8 collectively illustrate various details of a diving board 100 that may be used in commercial pools, residential pools, or other similar environments. The diving board 100 includes a shell 105 wrapped around a core 130 (illustrated in FIG. 6), the diving board 100 having one or more recessed areas or pockets 150, 155 formed at a depth relative to a top surface 110 of the shell 105. The recessed pockets 150, 155 support a non-slip tread surface 145 therein, the tread surface 145 having anti-slip characteristics to provide grip and traction to a diver walking across the tread surface 145. In some embodiments, the tread surface 145 may be made of a composite material that includes primarily a mixture of cork and rubber, but may also include other binders and additives. The resulting cork-composite tread surface 145 provides non-slip features for the diving board 100, as well as moisture resistance, fire resistance, improved wear resistance, stain and chemical resistance, and thermal resistance. These improved resistance characteristics may be especially beneficial in an outdoor water environment where the diving board 100 is used. In other embodiments, the tread surface 145 may be made from other suitable materials other than cork and rubber such that the tread surface 145 provide adequate anti-slip functionality.

In one embodiment, the tread surface 145 may be mounted within the recessed pockets 150, 155 of the diving board 100, such that the tread surface 145 is entirely or substantially flush relative to the top surface 110 of the shell 105 to minimize and/or avoid potential tripping hazards and to prevent injuries that may otherwise occur with raised tread surfaces. With reference to the figures, the following provides additional details of the tread surface 145 and the diving board 100.

With particular reference to FIGS. 1-6, the diving board 100 includes a shell 105 having a top surface 110, an opposite bottom surface 115, a base end 120, and a forward or front end 125. To establish a frame of reference, the base end 120 is the back end or the end away from the pool, and the front end 125 is the end adjacent the water (see FIG. 8). The diving board 100 has a length extending along a longitudinal axis A from the base end 120 to the front end 125, and a width generally transverse to the longitudinal axis A. The diving board 100 may have any one of a variety of suitable length and width combinations to create desired flexibility and lift characteristics. For example, in one embodiment, the diving board 100 may have a length of about 8 feet and a width of about 1.5 feet. In other embodiments, the length of the diving board 100 may be any of 6 feet, 10 feet, or 12 feet long with a width ranging between 1-2 feet. It should be understood that in other embodiments, the length and width of the diving board 100 may be other suitable dimensions than those provided herein. The dimensions provided are for illustration purposes and not meant to be limiting.

In some embodiments, the thickness of the diving board 110 may taper from the base end 120 toward the front end 125. For example, in one embodiment, the diving board 100 may have a thickness of approximately 1.75 inches at the base end 120 and a thickness of approximately 1.30 inches at the front end 125, with the diving board 100 gradually tapering from the base end 120 toward the front end 125. Preferably, the thickness of the diving board 100 tapers linearly and uniformly, but in other embodiments, the diving board 100 may not taper uniformly. In still other embodiments, the diving board 100 may have different suitable thickness that may be based on the length and width dimensions of the diving board 100. In some embodiments, the thickness of the diving board 100 may range from approximately 1-2 inches as measured at the front end 125 and base end 120, respectively.

With particular reference to the cross section 6-6 illustrated in FIG. 6, the diving board 100 may include a core 130 made of any one of a variety of suitable materials to generally provide structural stability to the diving board 100, while still being sufficiently light so as to avoid adding significant weight. Generally, suitable cores 130 may have a density ranging from 60 $kg/m^3$ to 100 $kg/m^3$ and a compressive strength ranging from about 0.5 MPa to about 2.0 MPa. In yet other embodiments, the core 130 may comprise a fiberglass reinforced core material, which may include a combination of laminated wood layers and fiberglass mats. In other embodiments, other core materials may be suitable, such as a foam material including polyurethane, polyvinyl chloride, polyethylene, polystyrene. In other embodiments, the core 130 may comprise other suitable materials, such as laminated wood, cardboard, aluminum alloys, polyamides, and/or combinations thereof.

In some embodiments, the core 130 extends from the base end 120 to the front end 125 and across the width of the diving board 105. In other embodiments, the core 130 may terminate just short of the base and front ends 120, 125 and of the sides of the board 105. For example, with collective reference to FIGS. 2 and 6, the core 130 may be offset from lateral sides or edges 135 of the diving board 100 by a channel or gap 140 to impart additional flexibility to the sides/edges 135 of the diving board 100 during use. The channel 140 may extend around the entire perimeter of the underside of the diving board 100, thereby offsetting the core 130 from the sides of the diving board 100. The diving board 100 further includes a shell 105 wrapped around the core 130, such that the shell 105 directly contacts the core 130, preferably with no other layers or materials in between. The shell 105 may be made of any one of a variety of suitable materials, such as acrylic. It should be understood that the particular design of the core 130, shell 105, and diving board 100 presented in the figures are for illustration purposes and not intended to be limiting to the disclosed design. For example, in other embodiments, the core 130, shell 105, and diving board 100 may have different designs/configurations, or the diving board 100 may not include a core 130.

With general reference to FIGS. 1 and 7, the following section provides additional details of the tread surfaces 145 and their arrangement within a pair of recessed pockets 150, 155. The following description begins with details of the recessed pockets 150, 155 (as illustrated in FIG. 7), and thereafter describes details relating to the placement of the tread surfaces 145 within the recessed pockets 150, 155.

With particular reference to FIG. 7, the diving board 100 includes a first recessed pocket 150 and a second recessed pocket 155, each of which extending toward the core 130 at a depth relative to the top surface 110 of the shell 105. It should be understood that although the illustrated diving board 100 includes two distinct recessed pockets 150, 155 of varying sizes, in other embodiments, the diving board 100 may include only a single recessed area, such as a recessed area that extends along most of the length of the diving board 100 from the base end 120 to the front end 125, or may include multiple recessed areas of the same or different sizes, or any other suitable arrangement of recessed areas as desired. Preferably, the recessed pockets 150, 155 comprise the majority (e.g., 50% to 75%) of the top surface 110 of the diving board 100 to accommodate a large surface area for the tread surface 145 and provide maximum purchase for divers during use. In other embodiments, the recessed pockets 150, 155 may comprise at least 90% of the top surface 110.

The first recessed pocket 150 includes a substantially planar base surface 190 that forms the bottom of the recessed pocket 150. A first side wall 195 and an opposite second side wall 200 extend upwardly from the base surface 190 and adjoin with the top surface 110 of the shell 105, the side walls 195, 200 positioned adjacent to and offset from the lateral sides or edges 135 of the diving board 100. Preferably, the first and second side walls 195, 200 are substantially parallel to one another.

The pocket 150 further includes a first cross wall 205 and an opposite second cross wall 210, each of the cross walls 205, 210 extending upwardly from the base surface 190 and transversely across relative to the diving board 100, the cross walls 205, 210 each adjoining the first side wall 195 and the second side wall 200. The first cross wall 205 is disposed adjacent/proximal to and offset from the base end 120 of the shell 105, and the second cross wall 210 is disposed adjacent/proximal to and offset from a strip 215 of the top surface 110 that extends transversely across the shell 105. In this configuration, the first recessed pocket 150 forms an enclosed recessed region for receiving the tread surface 145 as further described below.

Similarly, the second recessed pocket 155 includes a substantially planar base surface 220 that forms the bottom of the recessed pocket 155. A first side wall 225 and an opposite second side wall 230 extend upwardly from the base surface 220 and adjoin with the top surface 110 of the shell 105, the side walls 225, 230 positioned adjacent to and offset from the lateral sides or edges 135 of the diving board 100. Preferably, the first and second side walls 225, 230 are substantially parallel to one another, with the first side wall 225 generally aligned with the first side wall 195 of the first pocket 150, and the second side wall 230 generally aligned with the second side wall 200 of the first pocket 150.

The pocket 155 further includes a cross wall 235 extending upwardly from the base surface 220 and transversely across relative to the diving board 100, the cross wall 235 adjoining the first side wall 225 and the second side wall 230. The cross wall 235 is disposed adjacent/proximal to and offset from the strip 215 of the top surface 110 that extends transversely across the shell 105. The pocket 155 includes an open end 240 formed along the front end 125 of the shell 105. In other words, the base surface 220 extends to and adjoins with a front surface 245 of the front end 125. In this configuration, the second recessed pocket 155 is forms a recessed region enclosed on three sides, and opened on a fourth side adjacent the front end 125 of the diving board 100.

As mentioned previously, the recessed pockets 150, 155 are preferably offset from the peripheral edges 135 of the diving board 100. For example, in one embodiment, the recessed pocket 150 may be offset from the base end 120 by a distance of between 1-2 inches, and may be offset from the peripheral edges 135 of the diving board by the same distance of between 1-2 inches. In other embodiments, the recessed pocket 150 may be offset from both the peripheral edges 135 and the base end 120 by between 1.2 and 1.5 inches. In still other embodiments, the recessed pocket 150 may extend closer to the edges 135 and the base end 120 to have a smaller offset than the described dimensions. In yet other embodiments, the recessed pocket 150 may instead extend to the edges 135 and the base end 120 with little to no offset.

Similarly, the recessed pocket 155 may be offset from the edges 135 of the diving board 100 by a distance of between 1-2 inches, or by a distance of between 1.2 and 1.5 inches in other embodiments. Preferably, both pockets 150, 155 are offset by equal distances from the lateral edges 135 to maintain a uniform design. Unlike the recessed pocket 150, however, the recessed pocket 155 preferably extends all the way to the front end 125 of the diving board 100 with no offset to accommodate the tread surface 145 at the front end 125 of the diving board 100 as illustrated in FIG. 1 and as further described in detail below.

As noted previously, the recessed pockets 150, 155 are each sized and dimensioned to receive a corresponding tread surface 145, the tread surface 145 providing a sufficiently large region with suitable traction for a diver when the diving board 100 is assembled. Returning to FIG. 1, the tread surface 145 is positioned within the pockets 150, 155 on the top surface 110 of the shell 105. The tread surface 145 is preferably a non-slip surface designed to minimize potential slipping or falling by a diver walking on the diving board 100. For example, the tread surface 145 may include a non-slip sanded tread or other suitable non-slip tread material. In other embodiments, the tread surface 145 is a cork composite surface comprising a mixture of cork and rubber, and may include other materials, such as binding agents, fillers, or other additives. In some embodiments, the tread surface 145 may comprise at least 10% cork of the volume of raw materials. In other embodiments, the tread surface 145 may comprise between 10% and 40% cork, or between 10% and 30% cork, or between 15% and 25% cork, or between 25% cork and 40% cork. In still other embodiments, the tread surface 145 may comprise primarily cork. For example, in some embodiments, cork may comprise at least 50% of the volume of raw materials of the tread surface 145. In other embodiments, cork may account for between 50% and 80% of the volume of raw materials of the tread surface 145. In other embodiments, the volume of raw materials comprising the tread surface 145 may include between 60% and 75% cork. In still other embodiments, the volume of raw materials may include at least 70% cork. For improved grip and purchase, the tread surface 145 may include raised bumps or studs (not shown), such as in a diamond, round, or other suitable shapes distributed throughout.

With reference to the cross-section in FIG. 6 and FIG. 6A, the following section provides additional details regarding arranging and adhering the tread surface 145 in the recessed pockets 150, 155. With collective reference to FIGS. 6 and 6A, an adhesive substance or layer 160 (e.g., glue, epoxy, resins, double-sided tape, or other suitable adhesives) may be used to adhere the tread surface 145 to the recessed pockets 150, 155 and firmly retain the tread surface 145 in position. Preferably, the adhesive substance 160 is a marine grade adhesive, such as a polyurethane adhesive/sealant that has excellent sealing capabilities as well as resistance to weathering. In such embodiments, the adhesive 160 is disposed on the base surface 190, 220 of the respective pockets 150, 155. In some embodiments, the adhesive 160 may also be disposed along the side walls 195, 200, 225, 230 and along the cross walls 205, 210, 235 to better adhere the tread surface 145 to the respective pockets 150, 155 and provide improved sealing capabilities to ensure that water or other debris does not penetrate and cause potential separation of the surface tread 145 from the diving board 100.

In other embodiments, the tread surface 145 may be coupled to the diving board 100 using other coupling techniques, such as screws, pins, clips, or other suitable fasteners. In some embodiments, the edges of the tread surface 145 may be slightly smaller than the dimensions of the recessed areas 150, 155 such that the tread surface 145 is slightly offset from the edges of the recessed areas 150, 155 when positioned therein. For example, in one embodiment, the edge of the tread surface 145 may be offset from the edge of the recessed area 150 by a gap (not shown) measuring between 0.05 and 0.15 inches. In other embodiments, the tread surface 145 may be offset by between 0.05 and 0.10 inches. In some embodiments, this gap may be filled with the adhesive substance 160 to ensure the tread surface 145 is firmly affixed to the recessed areas 150, 155 with little or no slippage.

Preferably, the recessed pockets 150, 155 are formed at a depth substantially equal to the thickness of the tread surface 145 such that the tread surface 145 is substantially flush relative to the top surface 110 of the shell 105 when the diving board 100 is assembled. For example, in one embodiment, the recessed areas 150, 155 may be formed at a depth of between 0.1 and 0.3 inches from the top surface 110 of the diving board 100. In other embodiments, the recessed areas 150, 155 may be formed at a depth of between 0.15 and 0.2 inches from the top surface 110. It should be understood that the depth of the recessed areas 150, 155 provided herein are meant as examples only and not meant to be limiting. As mentioned previously, the depth of the recessed areas 150, 155 are preferably sufficiently equal to the thickness of the tread surface 145.

In some embodiments, the tread surface 145 in the second pocket 155 is sized and dimensioned such that when the tread surface 145 is seated in the second pocket 155, the tread surface 145 extends from the cross wall 235 and terminates at the open end 240 of the pocket 155, where the tread surface 145 is substantially flush relative to the front surface 245 of the front end 125 of the shell 105. In other words, the tread surface 145 does not extend beyond the pocket 155 and/or does not contact the front surface 245 of the front end 125.

Figure 8:
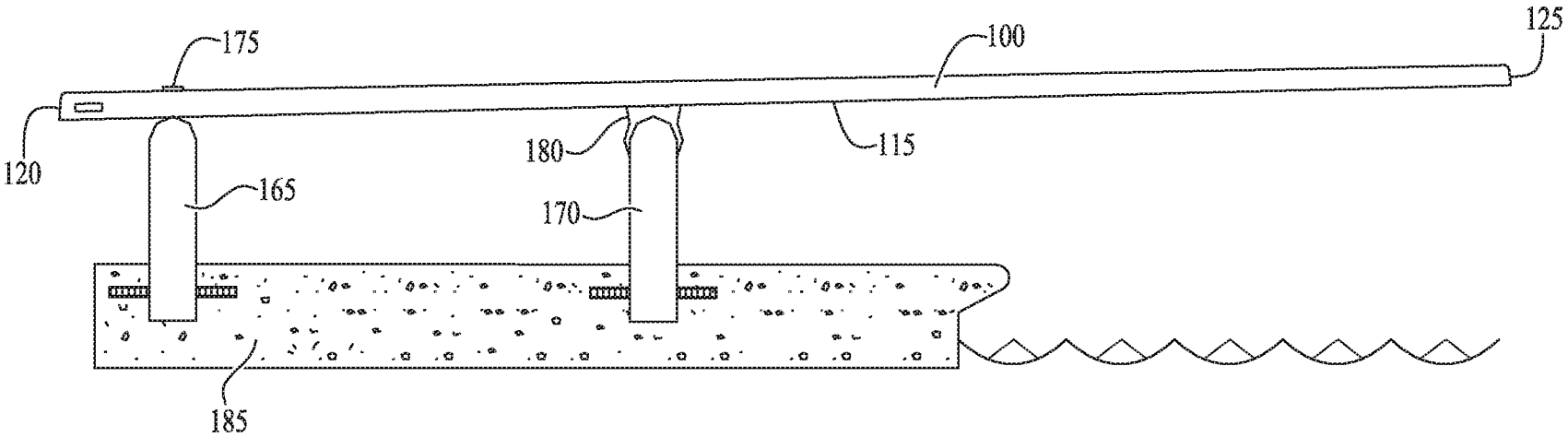
FIG. 8 is a schematic illustration of the diving board of FIG. 1 in an assembled and installed configuration.

FIG. 8 is a schematic illustration of the diving board 100 shown in an assembled and installed condition in accordance with one example embodiment. With reference to FIG. 8, the diving board 100 may be supported by one or more frame stands 165, 170, with a first frame stand 165 positioned adjacent the base end 120 of the diving board 100 and the second frame stand 170 positioned to achieved a desired fulcrum setting for the diving board 100. The diving board 100 may be coupled to the frame stand 165 via fasteners 175 that extend through the diving board 100 and are received in the frame stand 165. In some embodiments, a fulcrum pad 180 may be positioned between the frame stand 170 and the bottom surface 115 of the diving board 100 to support the diving board 100 in a cantilevered configuration over the water. The stands 165, 170 are in turn bolted or otherwise affixed to a concrete slab or other flooring material 185. It should be understood that in other embodiments, the diving board 100 may be installed in other arrangements or using different stands/frame structures to support the diving board 100 in a cantilevered configuration.

It is intended that subject matter disclosed in any one portion herein can be combined with the subject matter of one or more other portions herein as long as such combinations are not mutually exclusive or inoperable. In addition, many variations, enhancements and modifications of the concepts described herein are possible.

The terms and descriptions used above are set forth by way of illustration only and are not meant as limitations. Those skilled in the art will recognize that many variations can be made to the details of the above-described embodiments without departing from the underlying principles of the invention.

The invention claimed is:

1. A diving board comprising:

a shell having a top surface and an opposite bottom surface, the shell having a length extending along a longitudinal axis from a base end to a front end, and a width extending transversely relative to the longitudinal axis from a first side to a second side;

a first pocket recessed to a depth relative to the top surface of the shell, the first pocket having a base surface, a first side wall and an opposite second side wall extending upwardly from the base surface and toward the top surface of the shell, and a cross wall extending upwardly from the base surface and transversely across from the first side wall to the second side wall, wherein the base surface extends to and adjoins with a front surface of the front end of the shell to form an open end of the first pocket along the front end of the shell; and a first tread surface seated in the first pocket, the first tread surface mounted within the first pocket such that the tread surface is substantially flush relative to the top surface of the shell, and wherein the first tread surface terminates at the open end of the first pocket such that the first tread surface is substantially flush relative to the front surface of the front end of the shell.

2. The diving board of claim 1, further comprising an adhesive material disposed on the base surface of the first pocket, the adhesive material adhering the first tread surface onto the first pocket.

3. The diving board of claim 2, wherein the adhesive material is further disposed along the first side wall, the second side wall, and the cross wall to adhere the first tread surface thereto.

4. The diving board of claim 1, wherein the first tread surface comprises a cork composite tread surface.

5. The diving board of claim 4, wherein the cork composite tread surface further includes rubber.

6. The diving board of claim 4, wherein the cork composite tread surface includes between 50% and 80% cork by volume of raw materials.

7. The diving board of claim 1, wherein the first pocket is recessed to a depth of between 0.1 and 0.3 inches relative to the top surface of the shell.

8. The diving board of claim 1, further comprising:

a second pocket recessed to a depth relative to the top surface of the shell, the second pocket having a base surface, a first side wall and an opposite second side wall extending upwardly from the base surface and toward the top surface of the shell, and a first cross wall and an opposite second cross wall each extending upwardly from the base surface and transversely across from the first side wall to the second side wall; and a second tread surface seated in the second pocket, the second tread surface mounted within the second pocket such that the second tread surface is substantially flush relative to the top surface of the shell.

9. The diving board of claim 8, wherein the first cross wall of the second pocket is disposed proximal to and offset from the base end of the shell, and wherein the second cross wall of the second pocket is disposed proximal to and offset from the cross wall of the first pocket.

10. The diving board of claim 9, wherein a strip of the top surface of the shell extends transversely across from the first side of the shell to the second side of the shell, the strip disposed between and adjoining the cross wall of the first pocket and the second cross wall of the second pocket.

11. The diving board of claim 8, further comprising an adhesive material disposed on the base surface of the second pocket, the adhesive material adhering the second tread surface onto the second pocket.

12. The diving board of claim 11, wherein the adhesive material is further disposed along the first side wall, the second side wall, the first cross wall, and the second cross wall to adhere the second tread surface thereto.

13. The diving board of claim 8, wherein the second tread surface comprises a cork composite tread surface.

14. The diving board of claim 13, wherein the cork composite tread surface further includes rubber.

15. The diving board of claim 8, wherein the first pocket has a first margin offset from the first side of the shell and a second margin offset from the second side of the shell, and wherein the second pocket has a third margin offset from the first side of the shell and a fourth margin offset from the second side of the shell.

16. A diving board comprising:

a shell having a top surface and an opposite bottom surface, the shell having a length extending along a longitudinal axis from a base end to a front end, and a width extending transversely relative to the longitudinal axis from a first side to a second side;

a first pocket recessed to a depth relative to the top surface of the shell, the first pocket having a base surface, a first side wall and an opposite second side wall extending upwardly from the base surface and toward the top surface of the shell, and a cross wall extending upwardly from the base surface and transversely across from the first side wall to the second side wall, wherein the base surface extends to and adjoins with a front surface of the front end of the shell to form an open end of the first pocket along the front end of the shell;

a first tread surface seated in the first pocket, the first tread surface mounted within the first pocket such that the tread surface is substantially flush relative to the top surface of the shell;

a second pocket recessed to a depth relative to the top surface of the shell, the second pocket having a base surface, a first side wall and an opposite second side wall extending upwardly from the base surface and toward the top surface of the shell, and a first cross wall and an opposite second cross wall each extending upwardly from the base surface and transversely across from the first side wall to the second side wall; and a second tread surface seated in the second pocket, the second tread surface mounted within the second pocket such that the second tread surface is substantially flush relative to the top surface of the shell.

17. The diving board of claim 16, wherein the first tread surface terminates at the open end of the first pocket such that the first tread surface is substantially flush relative to the front surface of the front end of the shell.

18. The diving board of claim 16, wherein the first cross wall of the second pocket is disposed proximal to and offset from the base end of the shell, wherein the second cross wall of the second pocket is disposed proximal to and offset from the cross wall of the first pocket, and wherein a strip of the top surface of the shell extends transversely across from the first side of the shell to the second side of the shell, the strip disposed between and adjoining the cross wall of the first pocket and the second cross wall of the second pocket.

19. The diving board of claim 16, wherein the first pocket has a first margin offset from the first side of the shell and a second margin offset from the second side of the shell, and wherein the second pocket has a third margin offset from the first side of the shell and a fourth margin offset from the second side of the shell.

20. The diving board of claim 16, wherein the second tread surface comprises a cork composite tread surface.

* * * * *